US009548528B2

(12) United States Patent
Iso et al.

(10) Patent No.: US 9,548,528 B2
(45) Date of Patent: Jan. 17, 2017

(54) ANTENNA DEVICE

(71) Applicant: Hitachi Metals, Ltd., Tokyo (JP)

(72) Inventors: Naoki Iso, Hitachi (JP); Tomoyuki Ogawa, Hitachi (JP); Nobuaki Kitano, Hitachi (JP); Yoshiaki Ishigami, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 366 days.

(21) Appl. No.: 14/332,726

(22) Filed: Jul. 16, 2014

(65) Prior Publication Data

US 2015/0061965 A1 Mar. 5, 2015

(30) Foreign Application Priority Data

Aug. 30, 2013 (JP) ..... 2013-179483

(51) Int. Cl.

| | |
|---|---|
| ***H01Q 1/24*** | (2006.01) |
| ***H01Q 1/52*** | (2006.01) |
| ***H01Q 19/10*** | (2006.01) |
| ***H01Q 21/00*** | (2006.01) |
| ***H01Q 21/08*** | (2006.01) |

(52) U.S. Cl.

CPC ..... *H01Q 1/246* (2013.01); *H01Q 1/523* (2013.01); *H01Q 19/108* (2013.01); *H01Q 21/0006* (2013.01); *H01Q 21/08* (2013.01)

(58) Field of Classification Search

CPC .. H01Q 21/08; H01Q 21/0006; H01Q 19/108; H01Q 1/523; H01Q 1/246; H01Q 1/50

See application file for complete search history.

(56) References Cited

FOREIGN PATENT DOCUMENTS

JP 63-088902 A 4/1988

*Primary Examiner* — Michael C Wimer
*Assistant Examiner* — Noel Maldonado
(74) *Attorney, Agent, or Firm* — McGinn IP Law Group, PLLC

(57) ABSTRACT

An antenna device includes a first triplate line and one or more second triplate lines that are connected to the first triplate line so as to cross the first triplate line. Two ground plates of each second triplate line include respective flange portions that are in contact with and fixed to a surface of one of two ground plates of the first triplate line. At least one of a surface of each flange portion that contacts the one of the ground plates of the first triplate line and the surface of the one of the ground plates of the first triplate line that contacts each flange portion is provided with an irregular portion for reducing a contact area between each flange portion and the one of the ground plates.

5 Claims, 4 Drawing Sheets

ANTENNA DEVICE

The present application is based on Japanese patent application No. 2013-179483 filed on Aug. 30, 2013, the entire contents of which are incorporated herein by reference.

BACKGROUND OF THE INVENTION

1. Field of the Invention The present invention relates to an antenna device.

2. Description of the Related Art

An antenna device including a triplate line, in which a central conductor plate is interposed between two ground plates, as a feed line has been developed as an example of an antenna device having a simple structure with which loss in the feed line can be reduced (see, for example, Japanese Unexamined Patent Application Publication No. 63-88902).

With the antenna device including the triplate line as the feed line, in the case where the antenna device is a frequency-sharing antenna capable of transmitting and receiving signals in a plurality of frequency bands, the feed line is required for each frequency band and each polarization. When all of the feed lines are assembled in a single triplate line, the triplate line has an extremely large area, and the size of the antenna device is increased.

Accordingly, the assignee of the present invention has proposed an antenna device including multiple triplate lines that are connected together so as to cross each other.

However, with the proposed antenna device, there is a risk that a contact failure will occur in a section where the ground plates of the triplate lines are connected to each other and intermodulation (IM) distortion will be increased.

SUMMARY OF THE INVENTION

Accordingly, an object of the present invention is to solve the above-described problem and provide an antenna device with which the intermodulation distortion can be reduced.

The present invention has been made to achieve the above-described object. An antenna device according to an aspect of the present invention includes triplate lines used as feed lines, each triplate line including two ground plates and a central conductor interposed between the ground plates with an air layer provided between the central conductor and each ground plate. The triplate lines include a first triplate line and a second triplate line connected to the first triplate line across the first triplate line. The two ground plates of the second triplate line include respective flange portions configured to contact with a surface of one of the ground plates of the first triplate line. The triplate lines include an irregular portion formed on at least one of a surface of each flange portion contacting the one of the ground plates of the first triplate line and the surface of the one of the ground plates of the first triplate line contacting each flange portion. The irregular portion is configured to reduce a contact area between each flange portion and the one of the ground plates.

The irregular portion may be formed only on the surface of the one of the ground plates of the first triplate line that contacts each flange portion.

Each flange portion may be fastened to the ground plates of the first triplate line with a bolt.

The irregular portion may include a protrusion formed by embossing.

The irregular portion may include a recess.

According to the present invention, an antenna device with which intermodulation distortion can be reduced can be provided.

DESCRIPTION OF THE PREFERRED EMBODIMENTS

An embodiment of the present invention will be described with reference to the accompanying drawings.

Figure 1A:
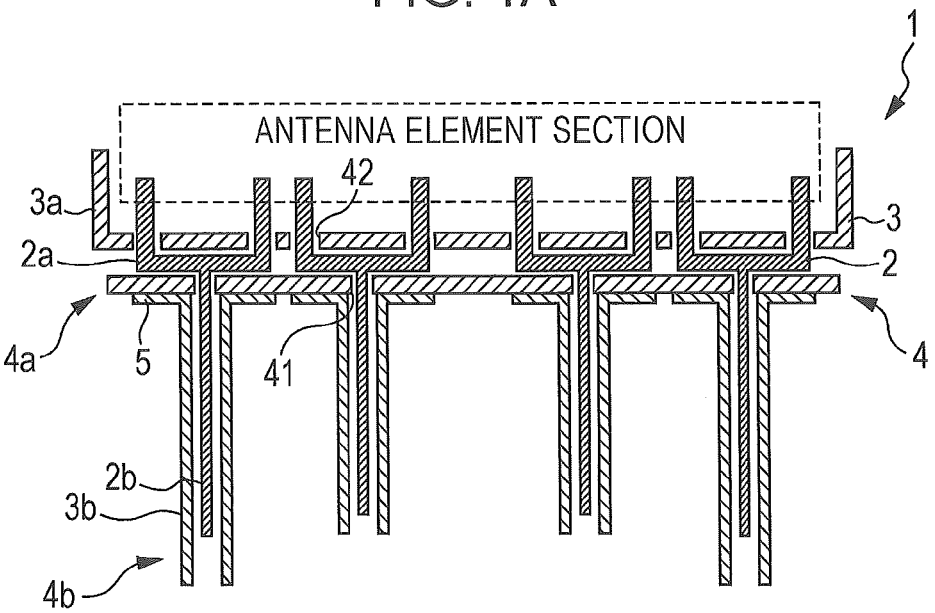
FIG. 1A is a schematic sectional view illustrating the manner in which triplate lines are connected in an antenna device according to an embodiment.
Figure 1B:
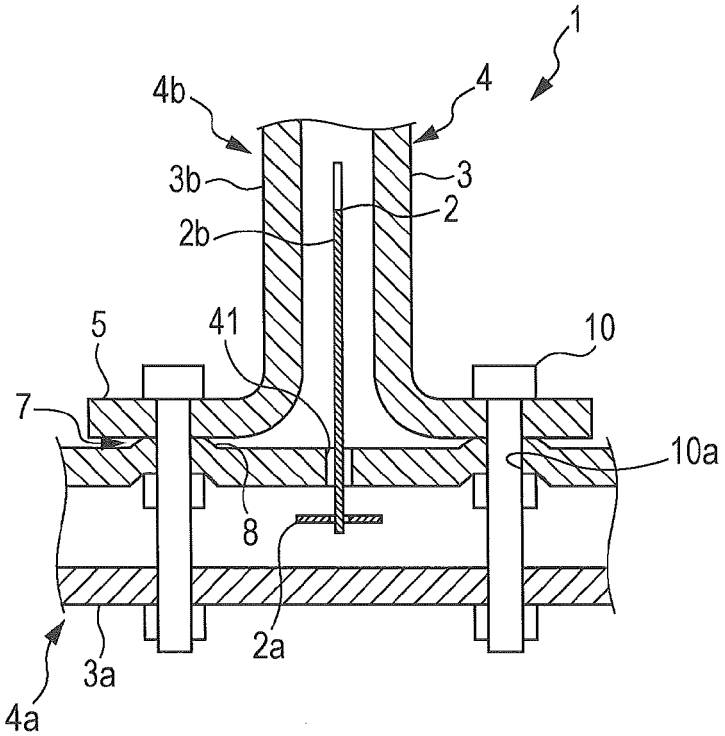
FIG. 1B is a sectional view of a connecting portion of a first triplate line and a second triplate line.

FIG. 1A is a schematic sectional view illustrating the manner in which triplate lines are connected in an antenna device according to the present embodiment. FIG. 1B is a sectional view of a connecting portion of a first triplate line and a second triplate line.

Figure 2A:
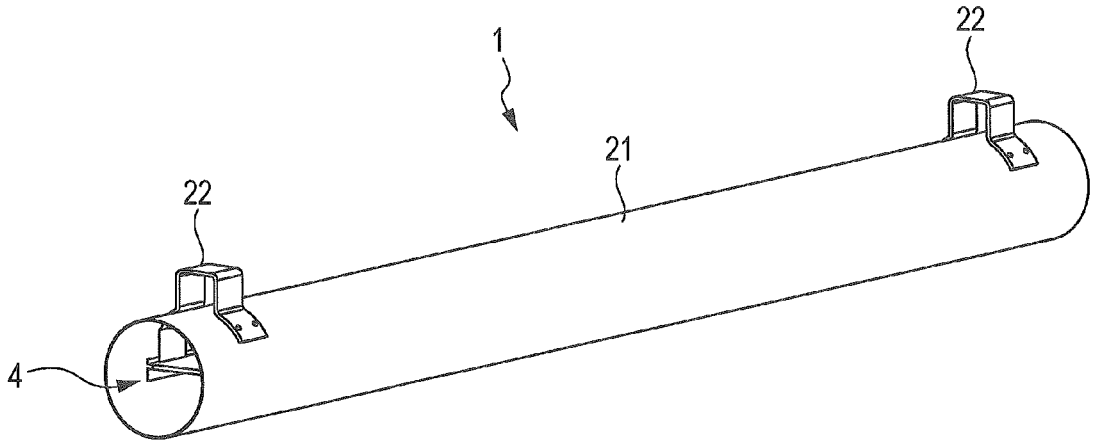
FIG. 2A is a perspective view illustrating an external appearance of the antenna device according to the embodiment.
Figure 2B:
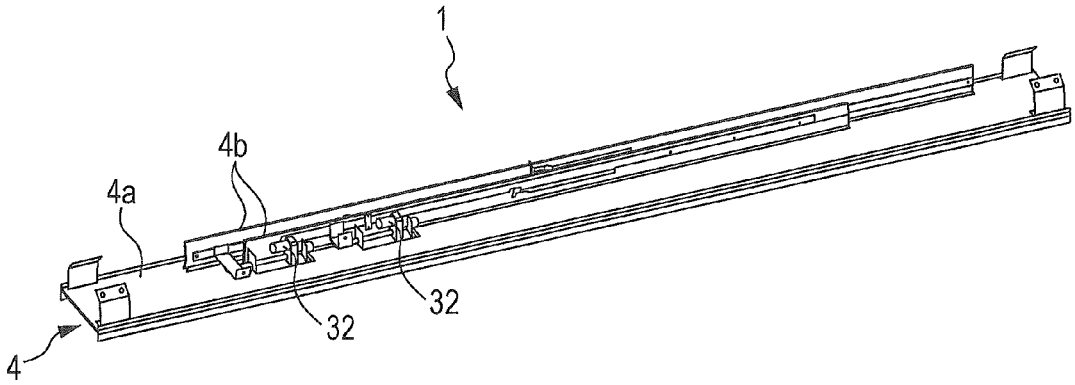
FIG. 2B is a perspective view of the antenna device in the state in which a radome, some of the triplate lines, and antenna elements are removed.
Figure 3:
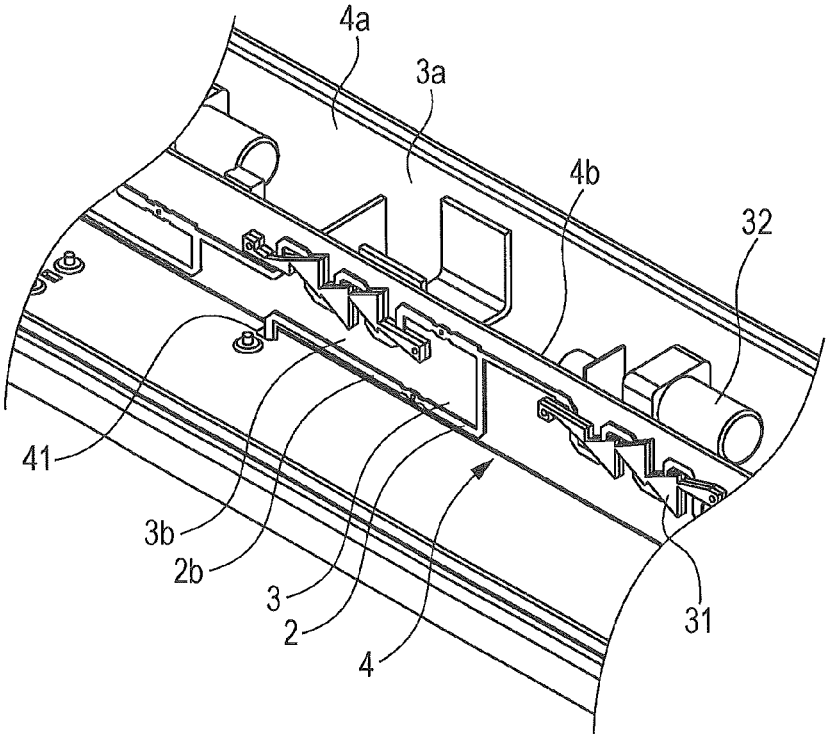
FIG. 3 is a perspective view illustrating the structure of a second triplate line, which is included in the antenna device illustrated in FIG. 1, in the state in which one ground plate is removed.

FIG. 2A is a perspective view illustrating an external appearance of the antenna device according to the present embodiment. FIG. 2B is a perspective view of the antenna device in the state in which a radome, some of the triplate lines, and antenna elements are removed.

As illustrated in FIGS. 1A, 1B, 2A, and 2B, an antenna device 1 includes triplate lines 4 as feed lines, each triplate line 4 including two ground plates 3 and a central conductor 2 interposed between the ground plates 3 with an air layer provided between the central conductor 2 and each ground plate 3. The antenna device 1 is used as, for example, a base station antenna for mobile communication.

The antenna device 1 includes a cylindrical radome 21. The triplate lines 4 are contained in the radome 21. Both ends of the radome 21 are covered with antenna caps (not shown). Attachment pieces 22 used to fix the radome 21 to an antenna tower or the like are provided on the radome 21. The antenna device 1 is attached to the antenna tower or the like by using the attachment pieces 22 such that the axial direction (longitudinal direction) of the radome 21 is vertical.

In the present embodiment, it is assumed that the antenna device 1 is a frequency-sharing antenna capable of transmitting and receiving signals in two frequency bands. When the antenna device 1 is used as a frequency-sharing antenna for two frequency bands, and when vertical and horizontal polarizations are used for each frequency band, four feed lines are required. If all of the four feed lines are assembled in a single triplate line 4, the triplate line 4 has an extremely large area, and the size of the antenna device is increased. Accordingly, in the present embodiment, multiple triplate lines 4 are provided, and are connected together so as to cross each other.

More specifically, the triplate lines 4 include a first triplate line (horizontal triplate line) 4*a* and one or more second triplate lines (vertical triplate lines) 4*b* that are connected to the first triplate line 4*a* so as to cross the first triplate line 4*a*. In this embodiment, one second triplate line 4*b* is provided for each of the four feed lines, and four second triplate lines 4*b* are provided in total. The four second triplate lines 4*b* are connected to the first triplate line 4*a* so as to be orthogonal to the first triplate line 4*a*.

The antenna device 1 is configured such that feed signals supplied from the outside are transmitted from the second triplate lines 4*b* to respective antenna elements through the first triplate line 4*a*. Here, the four second triplate lines 4*b* are arranged parallel to each other with intervals therebetween. Two second triplate lines 4*b* for a low frequency band (for example, 700 to 800 MHz) and the respective polarizations are disposed on the outer side, and two second triplate lines 4*b* for a high frequency band (for example, 1.5 to 2 GHz) and the respective polarizations are disposed on the inner side. The number of frequency bands is not limited to two, and the number and arrangement of the second triplate lines 4*b* are not limited to those in the figures.

The first triplate line 4*a* is configured such that a central conductor plate 2*a*, which is formed of a metal plate that serves as the central conductor 2, is interposed between two ground plates 3*a* with an air layer provided between the central conductor 2*a* and each ground plate 3*a*. The two ground plates 3*a* are arranged so as to be parallel to each other and face each other, and the central conductor plate 2*a* is arranged at a position equally spaced from the two ground plates 3*a*, that is, at the midpoint between the ground plates 3*a*.

Each second triplate line 4*b* is configured such that a central conductor plate 2*b*, which is formed of a metal plate that serves as the central conductor 2, is interposed between two ground plates 3*b* with an air layer provided between the central conductor 2*b* and each ground plate 3*b*. The two ground plates 3*b* are arranged so as to be parallel to each other and face each other, and the central conductor plate 2*b* is arranged at a position equally spaced from the two ground plates 3*b*, that is, at the midpoint between the ground plates 3*b*. The ground plates 3*a* and 3*b* are made of aluminum, which is light and inexpensive, and has high weather resistance.

As illustrated in FIGS. 1A to 3, dielectric-insertion-type phase shifters 31 are provided on the central conductor plates 2*b* of the second triplate lines 4*b*. The feed signals input from the outside are output to the first triplate line 4*a* after being distributed and subjected to phase adjustment. The dielectric-insertion-type phase shifters 31 are connected to respective linear motor units 32 for moving dielectric plates included therein along the central conductor plates 2*b*.

The two ground plates 3*b* of each second triplate line 4*b* have flange portions 5, which are in contact with and fixed to a surface of one of the ground plates 3*a* of the first triplate line 4*a*, and are substantially L-shaped in cross section. The flange portions 5 are fastened to the two ground plates 3*a* of the first triplate line 4*a* with bolts 10, so that the ground plates 3*a* and 3*b* are electrically connected and fixed to each other. Thus, the triplate lines 4*a* and 4*b* are fixed to each other.

An end of the central conductor plate 2*b* of each second triplate line 4*b* protrudes outward from the ground plates 3*b*, extends through a through hole 41 formed in one of the ground plates 3*a* of the first triplate line 4*a*, and is soldered on the central conductor plate 2*a* of the first triplate line 4*a* so as to be electrically connected to the central conductor plate 2*a*.

Figure 4:
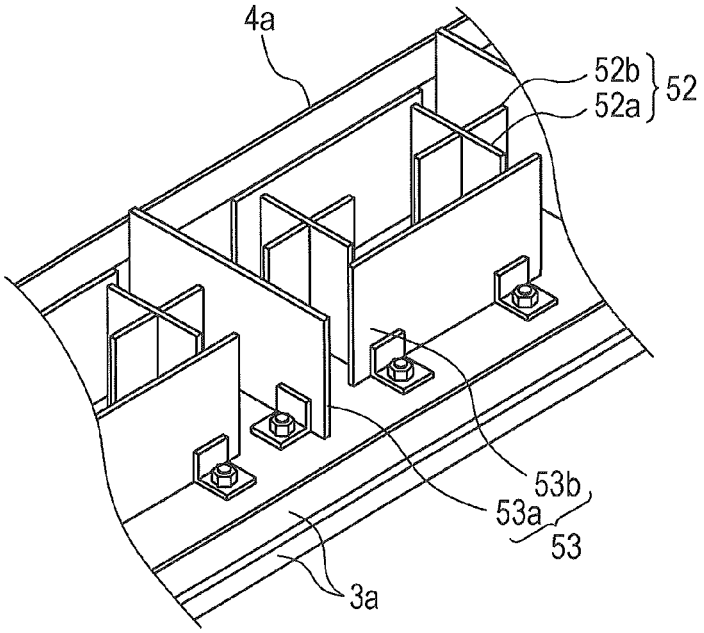
FIG. 4 is a perspective view illustrating the structure of an antenna element included in the antenna device illustrated in FIG. 1.

As illustrated in FIG. 4, antenna elements are disposed on the first triplate line 4*a* at a side opposite to a side at which the second triplate lines 4*b* are disposed. Thus, in the antenna device 1, the second triplate lines 4*b* are provided on one of the ground plates 3*a* of the first triplate line 4*a*, and the antenna elements are provided on the other of the ground plates 3*a* of the first triplate line 4*a*.

The antenna elements are constructed by forming a wiring pattern on a plate-shaped substrate made of an insulator, such as a resin, and are arranged so as to stand on one of the ground plates 3*a* of the first triplate line 4*a*.

The antenna elements include two pairs of antenna elements 52 and 53 which correspond to the respective frequency bands. A first pair of antenna elements 52 is for the high frequency band, and includes a first horizontal polarization antenna element 52*a* and a first vertical polarization antenna element 52*b*. A second pair of antenna elements 53 is for the low frequency band, and includes a second horizontal polarization antenna element 53*a* and a second vertical polarization antenna element 53*b*. The structure and arrangement of the antenna elements are not limited to those illustrated in the figures. The antenna elements are electrically connected to the central conductor plate 2*a* of the first triplate line 4*a* via through holes 42 formed in one of the ground plates 3*a* of the first triplate line 4*a* (see FIG. 1A).

Figure 5:
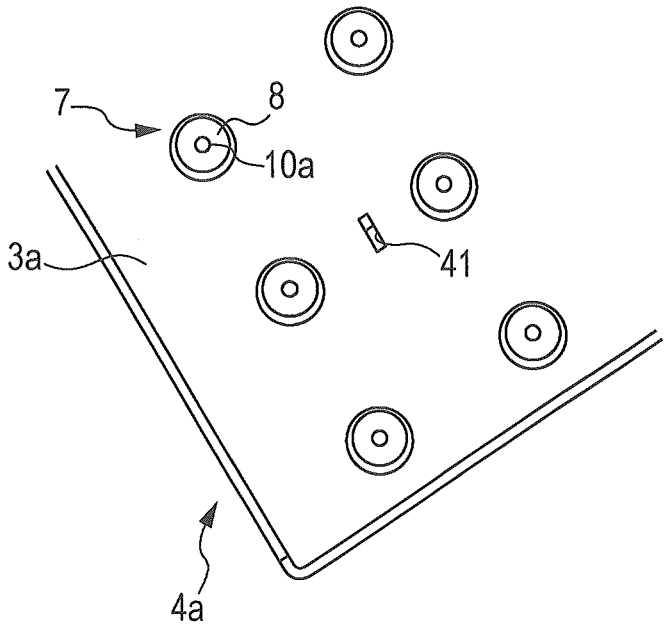
FIG. 5 is a perspective view of a ground plate of the first triplate line included in the antenna device illustrated in FIG. 1.

As illustrated in FIGS. 1B and 5, in the antenna device 1 of the present embodiment, at least one of a surface of each flange portion 5 that contacts one of the ground plates 3*a* and a surface of the ground plate 3*a* that contacts the flange portions 5 has an irregular portion 7 for reducing a contact area between each flange portion 5 and the ground plate 3*a*.

In the present embodiment, the irregular portion 7 is formed only on the surface of the ground plate 3*a*. However, the irregular portion 7 may instead be formed only on the contact surface of each flange portion 5, or on both of the surface of the ground plate 3*a* and the contact surface of each flange portion 5.

In the case where the irregular portion 7 is formed on each flange portion 5, it is necessary to perform the process of forming the irregular portion 7 on a plurality of members (in this example, on each of the eight ground plates 3*b*). However, in the case where the irregular portion 7 is formed only on the surface of the ground plate 3*a*, it is only necessary to perform the process on the ground plate 3*a*. Therefore, from the viewpoint of ease of manufacture, the irregular portion 7 is preferably formed only on the ground plate 3*a* as in the present embodiment.

In the antenna device 1, the irregular portion 7 includes protrusions 8 formed by an embossing process in which a rear surface is pressed so that a front surface protrudes outward. In this example, the protrusions 8 have a circular shape in plain view, and are centered on holes 10*a* for receiving the bolts 10. However, the shape of the protrusions 8 is not limited to this. Also, in this example, the height of the protrusions 8 (distance between the surface of the ground plate 3*a* and the top portion of each protrusion 8) is 1 mm. However, the height of the protrusions 8 can be changed as appropriate.

Since the protrusions 8 are formed as the irregular portion 7, only the top portions of the protrusions 8 contact the flange portions 5. Therefore, when the flange portions 5 of the ground plates 3*b* are fastened to the ground plates 3*a* with the bolts 10, the contact area can be reduced and the contact surface pressure between the ground plates 3*a* and 3*b* can be increased. As a result, the ground plates 3*a* and 3*b* can be stably and strongly fixed to each other, and the reliability of electrical connection therebetween can be increased.

The size and number of protrusions 8 are not particularly limited, and can be set as appropriate so that reliable electrical connection can be provided between the ground plates 3*a* and 3*b*. In the present embodiment, the protrusions 8 are located directly below the positions at which the bolts 10 are disposed. However, the protrusions 8 may instead be formed at positions other than the positions at which the bolts 10 are disposed.

Figure 6:
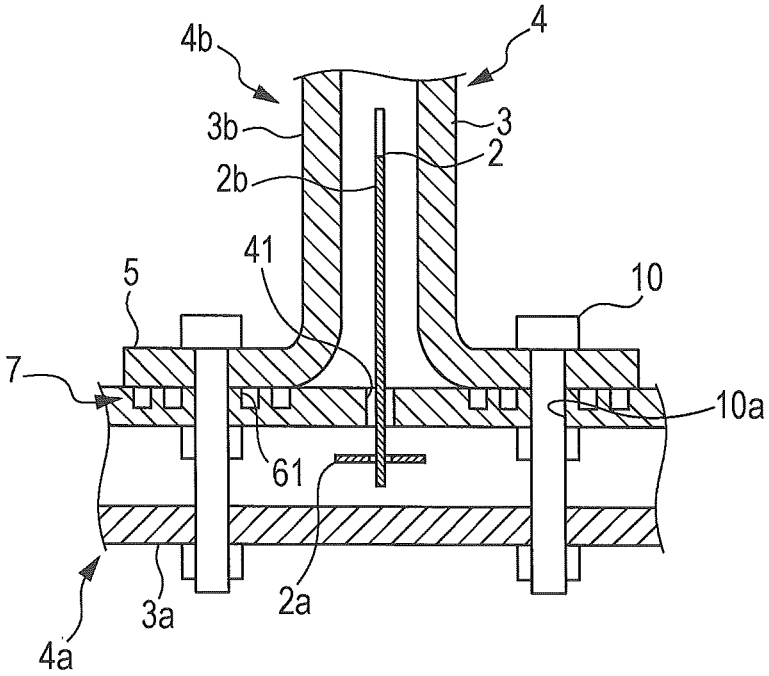
FIG. 6 is a sectional view of a connecting portion of a first triplate line and a second triplate line according to a modification of the present invention.

In the present embodiment, the protrusions 8 are formed as the irregular portion 7. However, as illustrated in FIG. 6, recesses 61 may instead be formed as the irregular portion 7. The recesses 61 may be formed such that the contact area between the flange portion 5 of each ground plate 3*b* and one of the ground plates 3*a* can be reduced and sufficient contact surface pressure can be obtained. In FIG. 6, the recesses 61 are formed in the ground plate 3*a*. However, the recesses 61 may instead be formed in the flange portion 5 of each ground plate 3*b*. The recesses 61 are not limited to those having a linear shape, and may have any shape.

As described above, in the antenna device 1 according to the present embodiment, at least one of the surface of the flange portion 5 of each ground plate 3*b* that contacts one of the ground plates 3*a* and the surface of the ground plate 3*a* that contacts the flange portions 5 has the irregular portion 7 for reducing the contact area between each flange portion 5 and the ground plate 3*a*.

Since the irregular portion 7 is formed, the contact surface pressure between the ground plates 3*a* and 3*b* can be increased, and the reliability of electrical connection can be increased. As a result, the risk of contact failure between the ground plates 3*a* and 3*b* can be reduced and the intermodulation distortion can be suppressed.

The present invention is not limited to the above-described embodiment, and various modifications are, of course, possible within the scope of the present invention.

For example, in the above-described embodiment, the triplate lines 4*a* and 4*b* respectively include the central conductor plates 2*a* and 2*b* as the central conductors 2. However, the present invention is not limited to this, and one or both of the triplate lines 4*a* and 4*b* may be a substrate triplate line in which a wiring pattern formed on a dielectric substrate is used as the central conductor 2.

What is claimed is:

1. An antenna device comprising:

triplate lines used as feed lines, each triplate line including two ground plates and a central conductor interposed between the ground plates with an air layer provided between the central conductor and each ground plate, wherein the triplate lines include a first triplate line;

a second triplate line connected to the first triplate line across the first triplate line, the two ground plates of the second triplate line including respective flange portions configured to contact with a surface of one of the ground plates of the first triplate line; and an irregular portion formed on at least one of a surface of each flange portion contacting the one of the ground plates of the first triplate line and the surface of the one of the ground plates of the first triplate line contacting each flange portion, the irregular portion configured to reduce a contact area between each flange portion and the one of the ground plates.

2. The antenna device according to claim 1, wherein the irregular portion is formed only on the surface of the one of the ground plates of the first triplate line that contacts each flange portion.

3. The antenna device according to claim 1, wherein each flange portion is fastened to the ground plates of the first triplate line with a bolt.

4. The antenna device according to claim 1, wherein the irregular portion includes a protrusion formed by embossing.

5. The antenna device according to claim 1, wherein the irregular portion includes a recess.

* * * * *